US011596252B1

(12) United States Patent
Lorimer

(10) Patent No.: US 11,596,252 B1
(45) Date of Patent: Mar. 7, 2023

(54) GARMENT STRETCHING ASSEMBLY

(71) Applicant: Troy Lorimer, Bellevue, WA (US)

(72) Inventor: Troy Lorimer, Bellevue, WA (US)

( * ) Notice: Subject to any disclaimer, the term of this patent is extended or adjusted under 35 U.S.C. 154(b) by 0 days.

(21) Appl. No.: 17/474,645

(22) Filed: Sep. 14, 2021

(51) Int. Cl.
*A47G 25/62* (2006.01)

(52) U.S. Cl.
CPC ..... *A47G 25/62* (2013.01)

(58) Field of Classification Search
CPC ..... A47G 25/20; A47G 25/62; A47G 25/621; A47G 25/622; A47G 25/625; A47G 25/626; Y10S 24/13; F16B 2/10; D06F 55/00; D06F 55/02
See application file for complete search history.

(56) References Cited

U.S. PATENT DOCUMENTS 1,435,674 A * 11/1922 Varga ..... D06F 55/00 16/DIG. 8
2,635,368 A * 4/1953 Greb-Lasky ..... A47G 25/62 38/70
2,703,444 A * 3/1955 Proth ..... A47G 25/485 24/564
2,765,487 A 10/1956 Foster
2,805,010 A 9/1957 Brookhart
2,922,209 A * 1/1960 Longhi ..... D06F 55/02 24/501
3,889,313 A * 6/1975 Hulthen ..... F16B 2/18 16/404
D342,890 S * 1/1994 Ramierz ..... D8/395
D490,216 S 5/2004 Powell
8,028,868 B2 10/2011 Mangano
8,393,015 B2 3/2013 Jones
9,351,528 B2 * 5/2016 Grimes ..... A41F 17/02
9,474,400 B2 * 10/2016 Farris ..... A47G 25/4023
9,687,036 B2 * 6/2017 Ditnes ..... A41F 17/02
10,201,242 B2 * 2/2019 Peska ..... A47G 25/68
2003/0019087 A1 * 1/2003 Pasin ..... B42F 1/006 24/545
2007/0295769 A1 * 12/2007 Burroughs ..... A47G 25/62 223/85
2017/0296297 A1 * 10/2017 Zulty ..... A61B 17/122

FOREIGN PATENT DOCUMENTS

EP 1975305 A1 * 10/2008 ..... A47G 25/20
WO WO20080981197 8/2008

* cited by examiner

*Primary Examiner* — F Griffin Hall

(57) ABSTRACT

A garment stretching assembly for stretching a shirt sleeve or a pant leg includes a clip that includes a first wing that compresses against a second wing. The clip can be suspended from a cuff of a shirt sleeve or a cuff of a pant leg. A pair of first weights is each integrated into a respective one of the first wing and the second wing to stretch the shirt sleeve or the pant leg when the clip is attached to the shirt sleeve or the pant leg. A plurality of second weights is provided and respective ones of the second weights is releasably attachable to a respective one of the first weights for increasing the weight of the clip.

4 Claims, 4 Drawing Sheets

GARMENT STRETCHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stretching devices and more particularly pertains to a new stretching device for stretching a shirt sleeve or a pant leg. The device includes a clip that is attachable to a cuff of a shirt sleeve or a cuff of a pant leg. The device includes a pair of first weights that are integrated into the clip to stretch the shirt sleeve or pant leg. In this way the shirt sleeve or the pant leg can be stretched to their original length due to shrinkage from drying. A plurality of second weights is provided and a selected number of the second weights can be attached to the first weights for increasing the total weight of the clip.

(2) Description of Related Art Including Information Disclosed Under 37 CFR 1.97 and 1.98

The prior art relates to stretching devices including a variety of weighted clamp devices that is attachable to laundry on a clothes line to inhibit the laundry from being wind whipped. The prior art discloses a laundry stretcher that includes a pair of clamps that are biased apart from each other and which can be attached to opposite ends of a garment for stretching the garment. The prior art discloses a weighted clothes pin for inhibiting laundry on a clothes line from being wind whipped. The prior art discloses a clothes stretcher that includes magnetized weights that engage an article of clothing on a clothes hanger for stretching wrinkles of the article of clothing.

BRIEF SUMMARY OF THE INVENTION

An embodiment of the disclosure meets the needs presented above by generally comprising a clip that includes a first wing that compresses against a second wing. The clip can be suspended from a cuff of a shirt sleeve or a cuff of a pant leg.

A pair of first weights is each integrated into a respective one of the first wing and the second wing to stretch the shirt sleeve or the pant leg when the clip is attached to the shirt sleeve or the pant leg. A plurality of second weights is provided and respective ones of the second weights is releasably attachable to a respective one of the first weights for increasing the weight of the clip.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
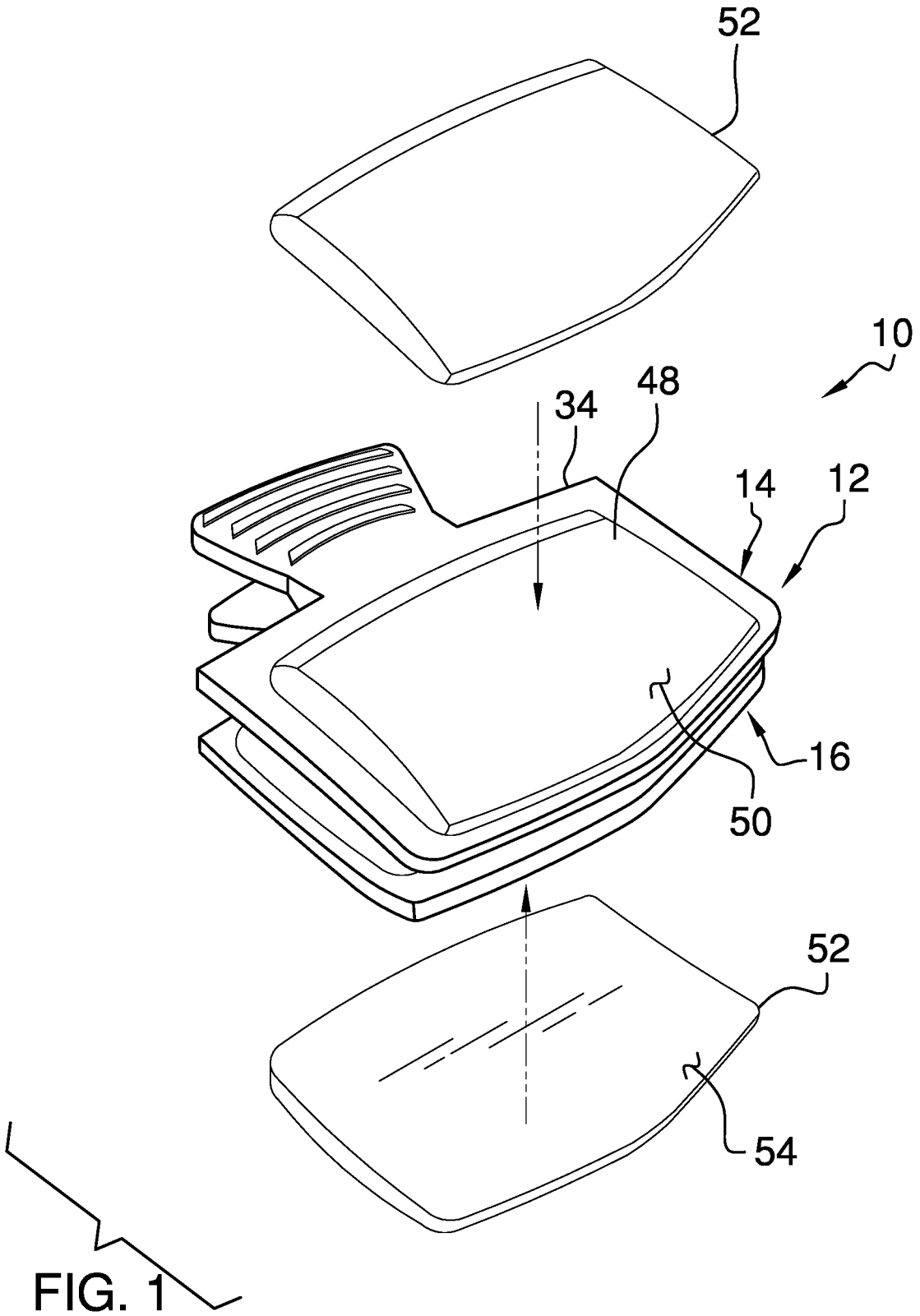
FIG. 1 is an exploded perspective view of a garment stretching assembly according to an embodiment of the disclosure.
Figure 2:
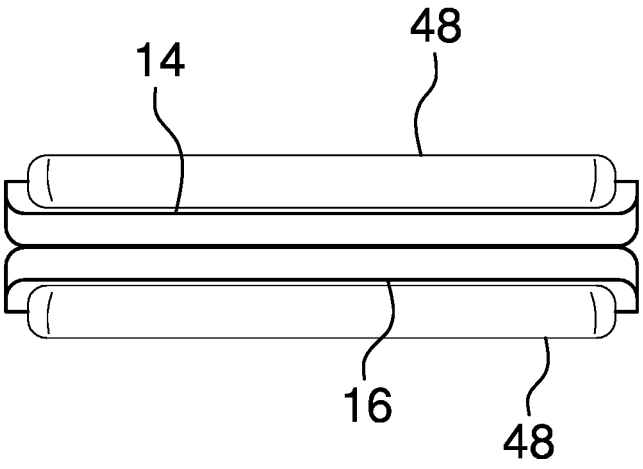
FIG. 2 is a front view of an embodiment of the disclosure.
Figure 3:
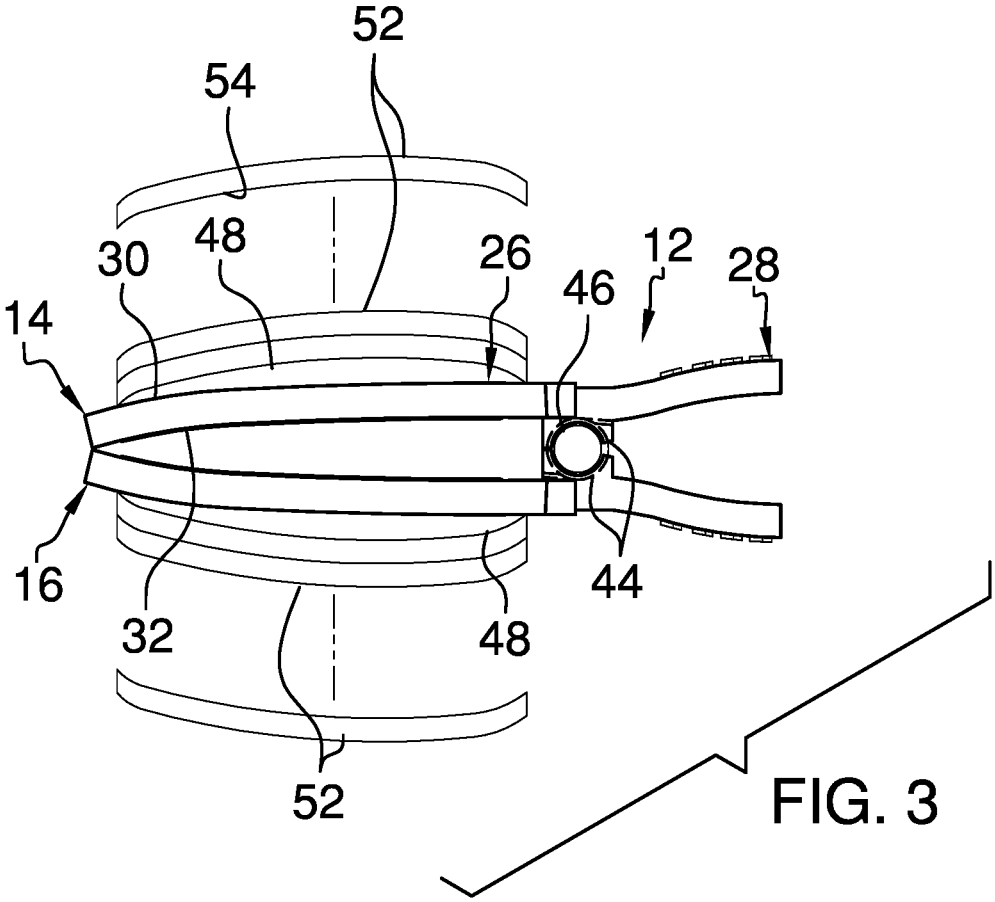
FIG. 3 is a left side exploded view of an embodiment of the disclosure.
Figure 4:
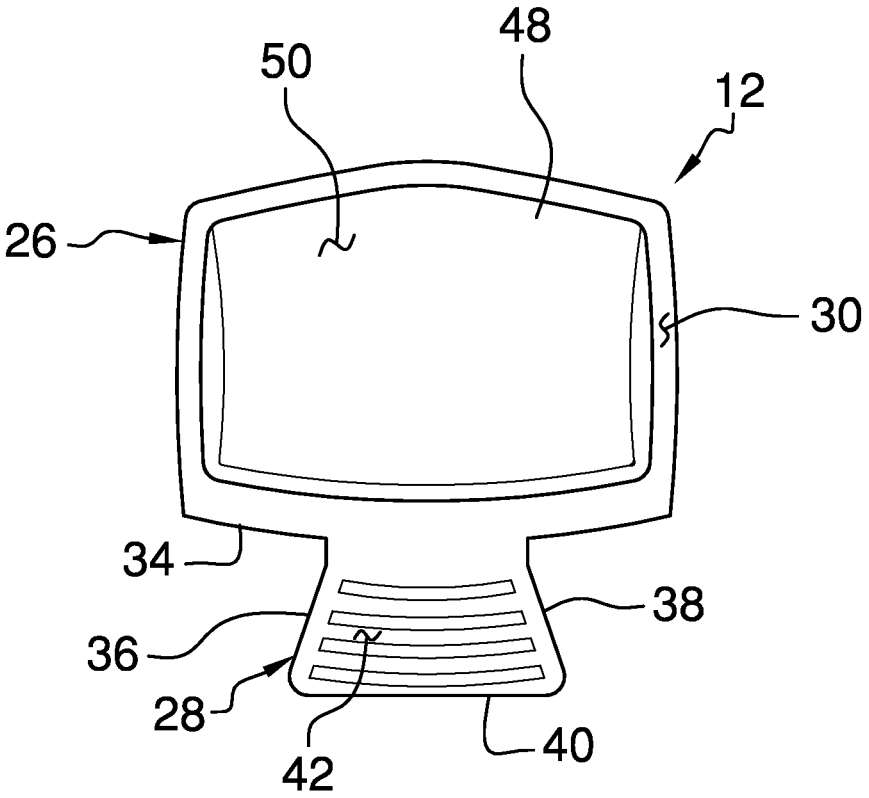
FIG. 4 is a top view of an embodiment of the disclosure.
Figure 5:
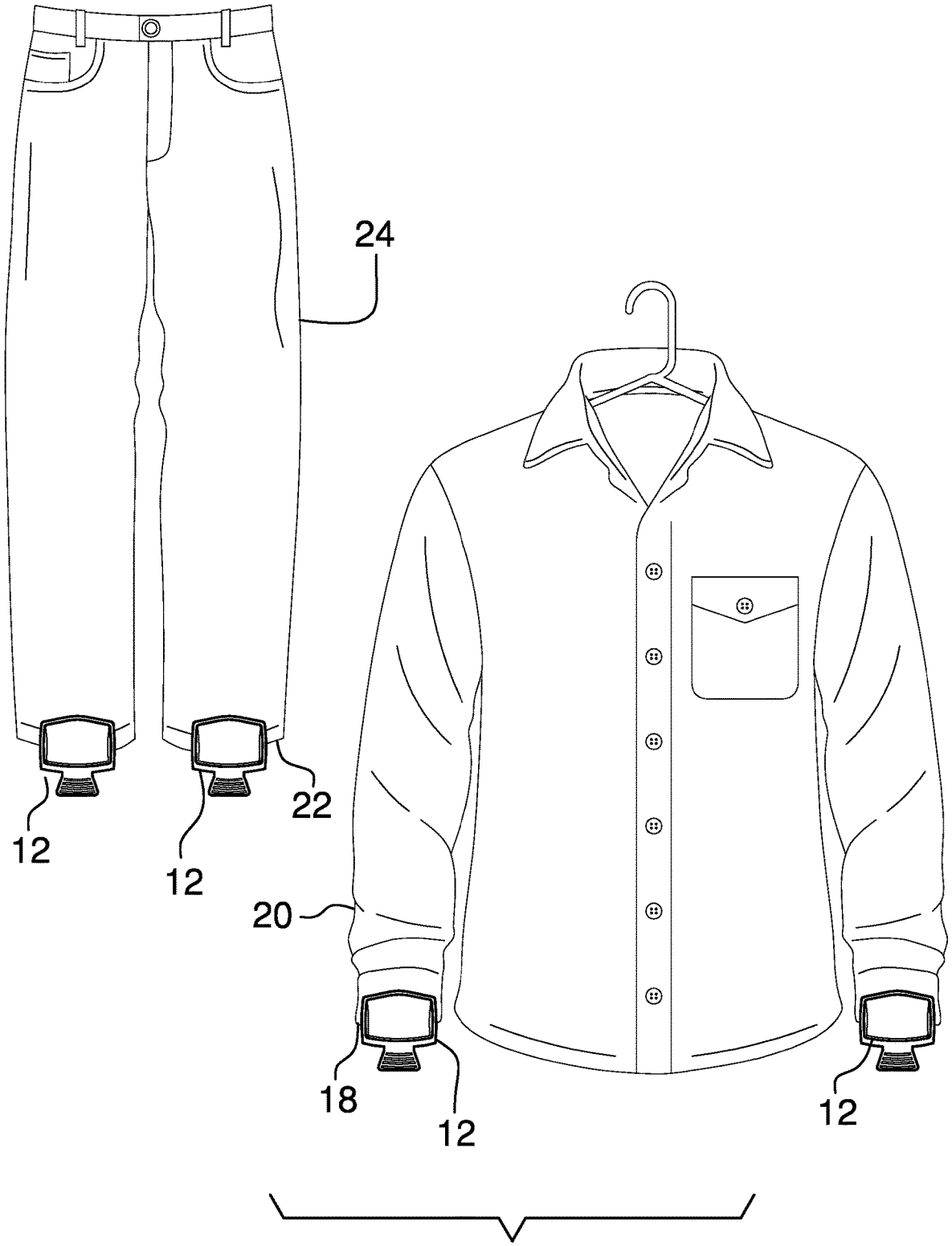
FIG. 5 is a perspective in-use view of an embodiment of the disclosure.

With reference now to the drawings, and in particular to FIGS. 1 through 5 thereof, a new stretching device embodying the principles and concepts of an embodiment of the disclosure and generally designated by the reference numeral 10 will be described.

As best illustrated in FIGS. 1 through 5, the garment stretching assembly 10 generally comprises a clip 12 which comprises a first wing 14 that is pivotally coupled to a second wing 16. The first wing 14 is biased to compress against the second wing 16 such that the clip 12 can be suspended from a cuff 18 of a shirt sleeve 20 or a cuff 22 of a pant leg 24. The shirt sleeve 20 may be a sleeve of a long sleeved shirt, for example, and the pant leg 24 may be a leg of a pair of jeans, for example.

Each of the first wing 14 and the second wing 16 comprise a panel portion 26 and a grip portion 28 extending away from the panel portion 26. The panel portion 26 has a first surface 30, a second surface 32 and a rear edge 34, and the grip portion 28 extends away from the rear edge 34. The grip portion 28 has a first lateral edge 36, a second lateral edge 38 and a distal edge 40 with respect to the rear edge 34 of the panel portion 26. Each of the first lateral edge 36 and the second lateral edge 38 angles outwardly between the rear edge 34 and the distal edge 40. The grip portion 28 has a first surface 42 lying on a plane that is oriented co-planar with the first surface 30 of the panel portion 26. Additionally, the first surface 42 of the grip portion 28 is textured to enhance gripping the first surface 42 of the grip portion 28.

The second surface 32 of the panel portion 26 of each of the wings has a hinge point 44 that is integrated into the second surface 32 of the panel portion 26. The hinge point 44 associated with each the first wing 14 and the second wing 16 is positioned adjacent to the rear edge 34 of the panel portion 26. Furthermore, the hinge point 44 associated with the first wing 14 hingedly engages the hinge point 44 associated with the second wing 16. A biasing member 46 is coupled to each of the first wing 14 and the second wing 16 to bias the first wing 14 to compress against the second wing 16. The biasing member 46 is integrated into the hinge point 44 associated with each of the first wing 14 and the second wing 16. Additionally, the biasing member 46 may comprise a spring or the like.

A pair of first weights 48 is each integrated into a respective one of the first wing 14 and the second wing 16. In this way the first weights 48 facilitate the clip 12 to stretch the shirt sleeve 20 or the pant leg 24 when the clip 12 is attached to the shirt sleeve 20 or the pant leg 24. Thus, shirt sleeves 20 or pant legs 24 that typically shrink from drying can be stretched back out to their original length. Each of the first weights 48 is integrated into the first surface 30 of the panel portion 26 of the respective first wing 14 or the second wing 16. Additionally, each of the first weights 48 has an exposed surface 50 with respect to the first surface 30 of the panel portion 26 of the respective first wing 14 and the second wing 16.

A plurality of second weights 52 is provided and respective ones of the second weights 52 are releasably attachable to a respective one of the first weights 48. In this way the weight of the clip 12 can be increased in order to fully stretch the shirt sleeve 20 or the pant leg 24 when the weight of the first weights 48 is not enough. Each of the second weights 52 has a coupling surface 54 and the coupling surface 54 of each of the second weights 52 engages the exposed surface 50 of the respective first weight. As is most clearly shown in FIG. 3, the exposed surface 50 of the first weights 48 may be convexly arcuate and the coupling surface 54 of each of the second weights 52 may be concavely arcuate to conform to the exposed surface 50. Furthermore, a selectable number of the second weights 52 are stackable onto each other thereby facilitating the weight of the clip 12 to be incrementally increased. The coupling surface 54 of each of the second weights 52 may include an adhesive layer to engage the exposed surface 50 of the first weights 48.

In use, the clip 12 is attached to the cuff 18 of the shirt sleeve 20 or the cuff 22 of the pant leg 24. In this way the first weights 48, and whatever number of second weights 52 is added to the first weights 48, can stretch the shirt sleeve 20 or the pant leg 24. Thus, the shirt sleeve 20 or the pant leg 24 can be lengthened to their original length after laundering. A selected number of the second weights 52 can be added to the first weights 48 to increase the total weight of the clip 12 to a sufficient weight to stretch the shirt sleeve 20 or the pant leg 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garment stretching assembly for stretching sleeves or legs of a garment back to their original length after laundering, said assembly comprising:

a clip comprising a first wing being pivotally coupled to a second wing, said first wing being biased to compress against said second wing, wherein said clip is configured to be suspended from a cuff of a shirt sleeve or a cuff of a pant leg;

a pair of first weights, each of said first weights being integrated into a respective one of said first wing and said second wing wherein each of said first weights are configured to stretch the shirt sleeve or the pant leg when said clip is attached to the shirt sleeve or the pant leg, a plurality of second weights, respective ones of said second weights being releasably attachable to a respective one of said first weights for increasing the weight of said clip, wherein said second weights are configured to stretch the shirt sleeve of the pant leg when said clip is attached to the shirt sleeve or the pant leg;

wherein each of said first wing and said second wing comprises a panel portion and a grip portion extending away from said panel portion, said panel portion having a first surface, a second surface and a rear edge, said grip portion extending away from said rear edge, said grip portion having a first lateral edge, a second lateral edge and a distal edge with respect to said rear edge of said panel portion, each of said first lateral edge and said second lateral edge angling outwardly between said rear edge and said distal edge, said grip portion having a first surface lying on a plane being oriented co-planar with said first surface of said panel portion, said first surface of said grip portion being textured to enhance gripping said first surface of said grip portion;

wherein each of said first weights is integrated into said first surface of said panel portion of said respective first wing or said second wing, each of said first weights having an exposed surface with respect to said first surface of said panel portion of said respective first wing and said second wing; and wherein each of said second weights has a coupling surface, said coupling surface of each of said second weights engaging said exposed surface of said respective first weight, a selectable number of said second weights being stackable onto each other thereby facilitating the weight of said clip to be incrementally increased.

2. The assembly according to claim 1, wherein said second surface of said panel portion of each of said wings has a hinge point being integrated into said second surface of said panel portion, said hinge point associated with each said first wing and said second wing being positioned adjacent to said rear edge of said panel portion, said hinge point associated with said first wing hingedly engaging said hinge point associated with said second wing.

3. The assembly according to claim 2, further comprising a biasing member being coupled to each of said first wing and said second wing, said biasing member biasing said first wing to compress against said second wing, said biasing member being integrated into said hinge point associated with each of said first wing and said second wing.

4. A garment stretching assembly for stretching sleeves or legs of a garment back to their original length after laundering, said assembly comprising:

a clip comprising a first wing being pivotally coupled to a second wing, said first wing being biased to compress against said second wing, wherein said clip is configured to be suspended from a cuff of a shirt sleeve or a cuff of a pant leg, each of said first wing and said second wing comprising a panel portion and a grip portion extending away from said panel portion, said panel portion having a first surface, a second surface and a rear edge, said grip portion extending away from said rear edge, said grip portion having a first lateral edge, a second lateral edge and a distal edge with respect to said rear edge of said panel portion, each of said first lateral edge and said second lateral edge angling outwardly between said rear edge and said distal edge, said grip portion having a first surface lying on a plane being oriented co-planar with said first surface of said panel portion, said second surface of said panel portion of each of said wings having a hinge point being integrated into said second surface of said panel portion, said hinge point associated with each said first wing and said second wing being positioned adjacent to said rear edge of said panel portion, said hinge point associated with said first wing hingedly engaging said hinge point associated with said second wing, said first surface of said grip portion being textured to enhance gripping said first surface of said grip portion;

a biasing member being coupled to each of said first wing and said second wing, said biasing member biasing said first wing to compress against said second wing, said biasing member being integrated into said hinge point associated with each of said first wing and said second wing;

a pair of first weights, each of said first weights being integrated into a respective one of said first wing and said second wing wherein each of said first weights are configured to stretch the shirt sleeve or the pant leg when said clip is attached to the shirt sleeve or the pant leg, each of said first weights being integrated into said first surface of said panel portion of said respective first wing or said second wing, each of said first weights having an exposed surface with respect to said first surface of said panel portion of said respective first wing and said second wing; and a plurality of second weights, respective ones of said second weights being releasably attachable to a respective one of said first weights for increasing the weight of said clip, wherein said second weights are configured to stretch the shirt sleeve of the pant leg when said clip is attached to the shirt sleeve or the pant leg, each of said second weights having a coupling surface, said coupling surface of each of said second weights engaging said exposed surface of said respective first weight, a selectable number of said second weights being stackable onto each other thereby facilitating the weight of said clip to be incrementally increased.

* * * * *